United States Patent [19]

Stahlecker

[11] Patent Number: 4,995,229

[45] Date of Patent: Feb. 26, 1991

[54] PROCESS AND AN ARRANGEMENT FOR PICKING UP A YARN END OF A SPOOL PACKAGE DURING A PIECING OPERATION

[75] Inventor: Fritz Stahlecker, Bad Ueberkingen, Fed. Rep. of Germany

[73] Assignee: Hans Stahlecker, Fed. Rep. of Germany; a part interest

[21] Appl. No.: 396,348

[22] Filed: Aug. 21, 1989

[30] Foreign Application Priority Data

Aug. 20, 1988 [DE] Fed. Rep. of Germany ..... 3828323

[51] Int. Cl.[5] ..... D01H 1/115; D01H 15/013

[52] U.S. Cl. ..... 57/261; 57/328

[58] Field of Search ..... 57/328, 350, 261, 263

[56] References Cited

U.S. PATENT DOCUMENTS 4,790,130 12/1988 Stahlecker et al. ..... 57/261

4,833,874 5/1989 Stahlecker et al. ..... 57/261

*Primary Examiner*—Joseph J. Hail, III

*Attorney, Agent, or Firm*—Evenson, Wands, Edwards, Lenahan & McKeown

[57] ABSTRACT

In a process and an arrangement for picking up a yarn end of a spool during piecing at a spinning unit which produces packages with double yarns which are used as feeding packages for a twisting operation, it is provided that, in the case of a yarn breakage, the winding-up and the spinning operation is interrupted in such a manner that the unbroken yarn of the double yarn is held in a yarn pick-up position, from which it is picked up during the piecing by means of a suction gripper which can be applied to the yarn pick-up position. After an unsuccessful piecing attempt, this suction gripper is applied to the circumference of the spool in order to still be able to take up the double yarn even then. In the event of a double yarn breakage, the suction gripper is movable to the circumference of the spool yarn seeking position, without first moving to the yarn pick-up position.

23 Claims, 3 Drawing Sheets

A
B
C
II
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
66

PROCESS AND AN ARRANGEMENT FOR PICKING UP A YARN END OF A SPOOL PACKAGE DURING A PIECING OPERATION

BACKGROUND AND SUMMARY OF THE INVENTION

The invention relates to a process and an arrangement for picking up a yarn end of a spool package during a piecing operation at a spinning unit which produces packages serving as feeding packages for a subsequent twisting. The spinning unit is part of a spinning machine having a plurality of such spinning units in each of which two slivers are drawn and are subsequently prestrengthened by false-twisting into yarns which are guided together and are wound on the spool package as a double yarn.

In practice, it is difficult to pick up the yarn end of a double yarn at a spool package, particularly if both yarns are not broken simultaneously and are therefore not located at the same point of the spool package. In order to solve this problem, it is provided in an older commonly assigned patent application Ser. No 07/340,708 filed Apr. 20, 1989 now abandoned based on German Application No. 33661 p 38 13 368, which is no prior publication, that in the case of a yarn breakage, the winding-up and the spinning operation is interrupted in such a manner that the unbroken yarn is held in a yarn pick-up position from which it can be picked up by means of a suction gripper during a piecing. During a piecing, only the unbroken yarn is then picked up first and wound off the spool package, this yarn, during the winding-off, taking along the broken yarn off the spool package, so that this yarn end can also be found and can also be withdrawn.

An object of the invention is to improve the picking-up of the yarn end.

This object is achieved in that, in the case of a yarn breakage, the winding-up and the spinning operation are interrupted in such a manner that the unbroken yarn end is held in a yarn pick-up position from which, during the piecing, it is picked u by means of a suction gripper which can be applied to the yarn pick-up position, and in that, after an unsuccessful piecing attempt, the suction gripper is applied to the circumference of the spool package.

This construction takes into account the circumstance that situations exist in which no yarn is available in the yarn pick-up position. The possibility is then opened up to nevertheless pick up the yarn end at the spool package. This type of a situation may occur if, for example, both yarn components break simultaneously or almost simultaneously, so that both yarns are completely wound onto the spool package. In this case, the first attempt must be unsuccessful because no yarn is withdrawn from the spool Package. This situation will also occur when the first piecing attempt was unsuccessful because then a yarn is also no longer available in the yarn pick-up position.

In a further development of certain preferred embodiments of the invention, it is provided that, in the case of a breakage of both yarn components, the suction gripper is applied to the circumference of the spool package for the subsequent piecing attempt. In this case, the circumstance may be taken into account that then a first spinning attempt will not be carried out at all which, because of an absence of a yarn at the yarn pick-up position, must necessarily remain unsuccessful.

In a further development of certain preferred embodiments of the invention, it is provided, in the case of an arrangement for picking up a yarn end of a spool package during piecing, that the devices for monitoring yarn breakage and for interrupting the spinning operation contain a sequence control which first interrupts the winding-up of the remaining yarn and then the spinning operation, that devices are provided for keeping the yarn, which is not yet wound onto the spool package, available in a yarn pick-up position, and that a suction gripper is provided which can be applied to the yarn pick-up position and to the circumference of the spool package. Such a suction gripper can therefore, pick up an individual yarn in two different positions and, if necessary, also a double yarn. In this case, it is provided in an expedient development that the suction gripper has a suction opening which is adapted to the path of the yarn in the yarn pick-up position and to the circumference of the spool package.

Other objects, advantages and novel features of the present invention will become apparent from the following detailed description of the invention when considered in conjunction with the accompanying drawings.

DETAILED DESCRIPTION OF THE DRAWINGS

Figure 1:
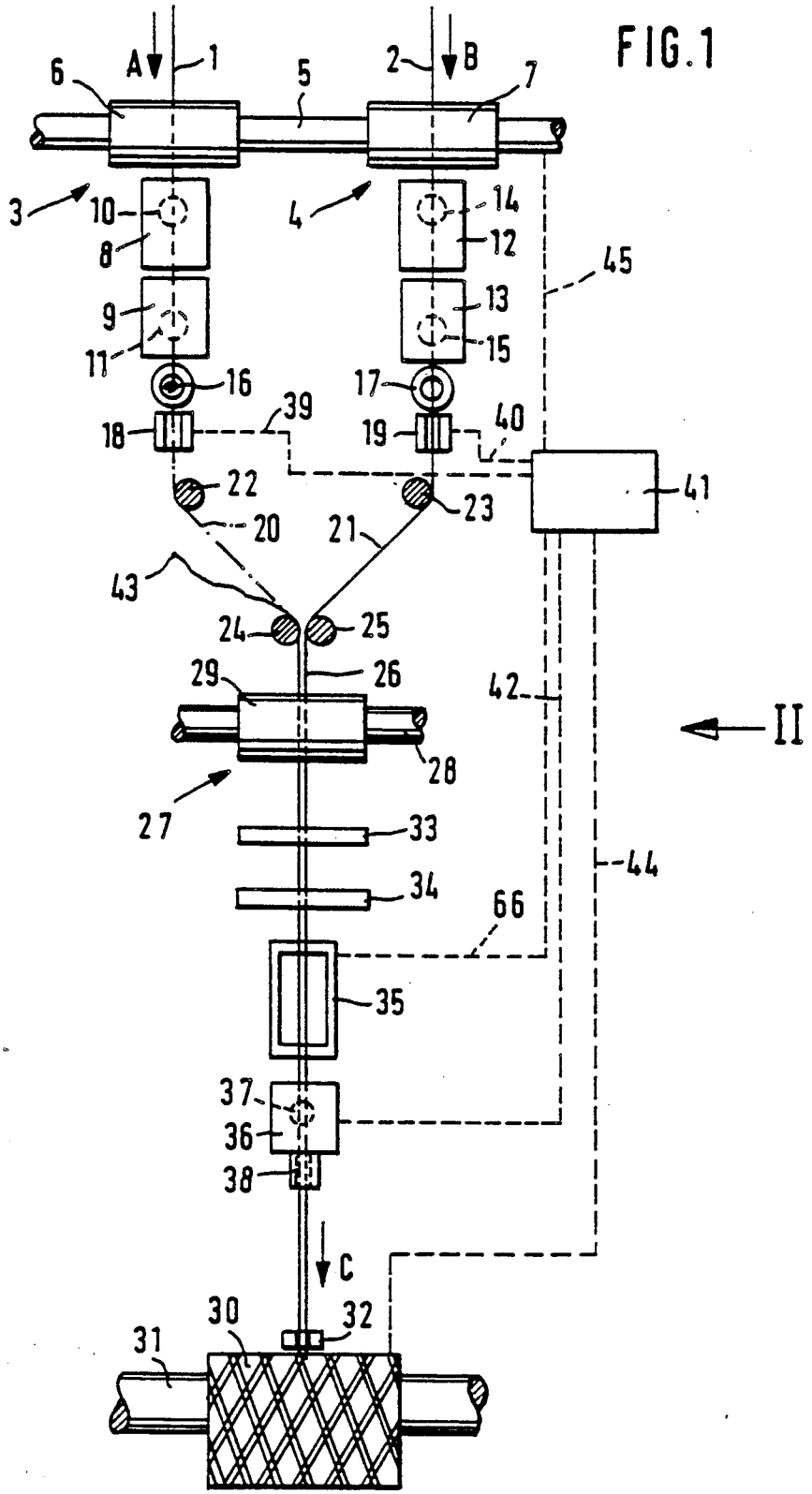
FIG. 1 is a schematic representation of a view of a spinning unit from the operators' side of a machine having a plurality of such spinning units, constructed in accordance with a preferred embodiment of the invention.

The spinning unit which is shown only partially in FIG. 1 is part of a spinning machine which has a plurality of such spinning units which are arranged in a row next to one another. The spinning unit contains two drafting units 3, 4 of which only the delivery roller pairs 5, 6; 5, 7 are shown. Two slivers 1, 2 move through the drafting units 3, 4 in the direction of the arrows (A, B) and are drafted or drawn to the desired yarn size. The drafting units 3, 4 contain bottom rollers which are driven at the machine end and extend through in the longitudinal direction of the machine, of which the bottom roller 5 of the delivery roller pair is shown. Each drafting unit 3, 4 also contains individual top rollers 6, 7 which are pressed against the bottom roller 5 in a manner not shown in detail.

Directly behind the drafting units 3, 4, pneumatic false twisting devices are arranged which comprise air nozzles 8, 9; 12, 13. The respective first air nozzles 8, 12 are constructed as so-called intake nozzles which provide the drawn slivers 1, 2 with no twist or, at the most, with a slight twist. The air nozzles 9, 12, which follow, are constructed as false-twisting nozzles. Compressed air supply lines 10, 11, 14, 15 are assigned to the air nozzles 8, 9; 12, 13. After the passage through the false twisting nozzles 9, 13, prestrengthened yarns 20.21 are obtained. Although the provided false twist opens up again, the fiber ends of some fibers remain wound around the then essentially untwisted core of the yarns 20, 21.

The false twisting nozzles 9, 13 are followed by suction pipes 16, 17 which take in fiber fly during the normal spinning operation.

Yarn detectors 18, 19 are connected behind the suction pipes 16, 17 and are connected to a control device 41. These yarn detectors 18, 19 signal the breakage of the respective yarn 20, 21.

The prestrengthened yarns 20, 21 are guided together to a double yarn 26 b y means of bolt-type yarn guides 22, 23, 24, 25. The yarn guides 24, 25 maintain a distance from one another so that the yarns 20, 21 in the double yarn 26, insofar as practically possible, are still clearly separated from one another, although they may touch one another at least partially.

The double yarn 26 is withdrawn by means of a withdrawal device 27 which contains a bottom cylinder 28, which extends through in the longitudinal direction of the machine and is driven at the machine end, and a pressure roller 29 which is pressed against the bottom cylinder 28. Subsequently, the , double yarn 26 moves in the direction of the arrow (C) to a wind-up device, by which it is wound on a spool package 30. The wind-up device contains a wind-up roller 31 which extends through in the longitudinal direction of the machine and is driven at the machine end, a cross-winding yarn guide 32 being assigned to this wind-up roller 31. The spool package itself, in a manner not shown in detail, is held by means of a spool package frame and is pressed against the wind-up roller 31.

Between the cross-winding device 32 and the withdrawal device 27, a compensating device 33, 34 is arranged which has a stationary guiding element 34 and a guiding element 33 which moves transversely with respect to the moving direction of the double yarn 26, by means of which the change of length can be compensated which is caused by the cross-winding yarn guide 32.

A suction device 35 and a twisting nozzle 36, which is connected to a compressed-air source by means of a compressed-air connection 37, are arranged between the compensating device 33, 34 and the cross-winding device 32. At the outlet of the twisting nozzle 36, a sleeve-shaped yarn guide 38 is located which limits the transverse movement of the double yarn 26 caused by the cross-winding yarn guide 32.

A lift-off mechanism is assigned to the spool package 30. In the embodiment shown, this lift-off mechanism includes a pneumatic press 47, the piston 48 of which can be moved out and is equipped with a roller 49 which can be applied to the circumference of the spool package 30, this roller 49, lifting the spool package 30 off its wind-up roller 31 (FIG. 2) when the piston 48 is moved out.

By means of the interrupted lines 39, 40, it is indicated that the yarn detectors 18, 19 are connected to the control device 41. The control device 41 is also provided with an actuating element for the lift-off device of the spool package 30, which is indicated by an interrupted line 44. In addition, the control device is provided with a valve controlling the compressed-air supply to the twisting nozzle 36, which is indicated by the interrupted line 42. In addition, the control device 41 is connected with a valve which connects the suction device 35 to a vacuum source, which is indicated by the interrupted line 66. In addition, the control device 41 controls the drafting units 3, 4, which is shown by an interrupted line 45. For this purpose, it may be provided that, by means of the control device 41, the top rollers, of which only the top delivery rollers 6, 7 are shown, are lifted off the pertaining bottom rollers, or that a sliver stopping device is actuated.

Figure 2:
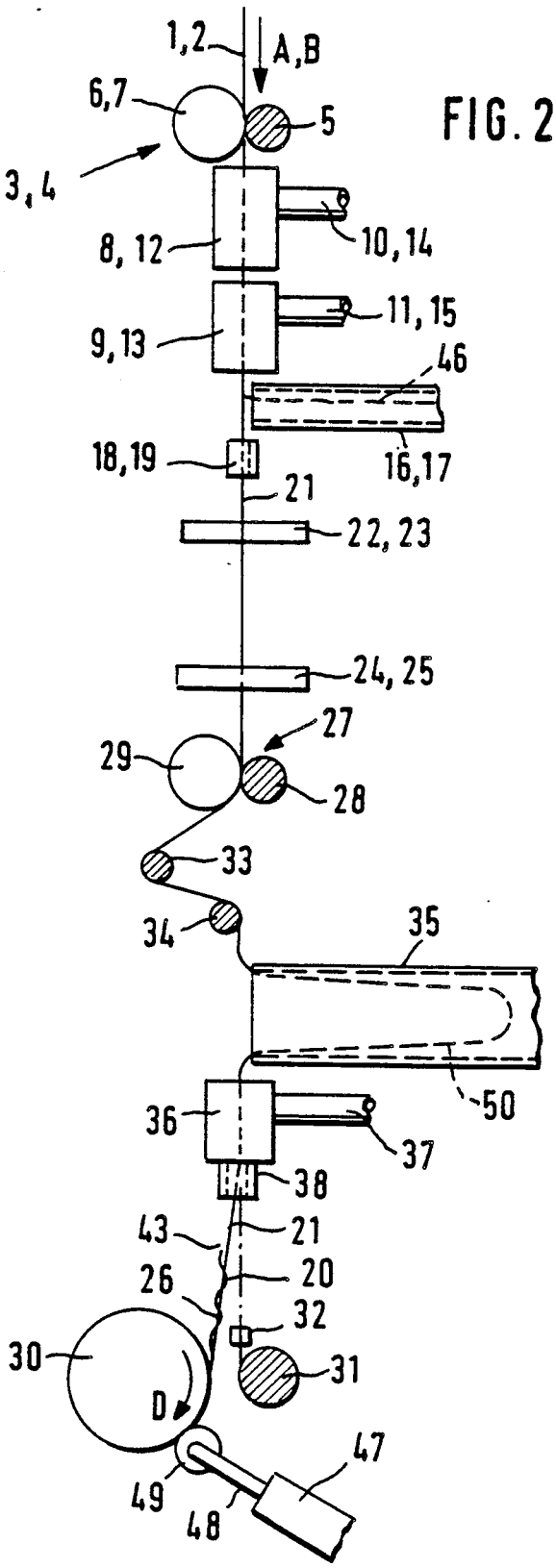
FIG. 2 is a schematic view of the spinning unit of FIG. 1 in the direction of the arrow II, showing the components after the breakage of one yarn of a double yarn formed of two yarns.

In FIG. 1, it is shown that the yarn 20 (shown by a dash-dotted line) is broken after passing through the false-twisting nozzle 9, so that there is a free yarn end 43. The yarn detector 18 has reported this event to the control device 41 which then interrupts the further winding-up of the double yarn 26 on the spool package 30 by lifting the spool package 30 off its wind-up roller 31. In addition, the suction device 35 and the false-twisting nozzle 36 are actuated by the switching of the corresponding valves by means of the control device 41. Since the drive of the spool package 30 is interrupted, less double yarn 26 than is delivered by the withdrawal device 27 is wound up until the spool package has stopped. This double yarn is taken in by the suction device 35 in the form of a loop 50 (FIG. 2). The twisting nozzle 36 provides a false twist to the unbroken yarn 21, in which case, however, the yarn end 43 of the broken yarn 20 is wound around the yarn 21 by means of a true twist, as soon as the Yarn 21 passes through the false twisting nozzle 36. As soon as the yarn end 43 has moved through the false-twisting nozzle 36, this false twisting nozzle 36 is switched off.

As soon as the spool package 30 has stopped, which is taken into account by the control device 41 by means of a given run-down time or by means of a discriminating element, the spinning operation is also interrupted by the control device 41 in that the continued supply of sliver 1, 2 is interrupted. The sliver 1, which had been supplied continuously until then, is taken in by the suction pipe 16 directly behind the false-twisting nozzle 9. The withdrawal device 27, which continues to run after the sliver supply was interrupted, will then also completely withdraw the then also broken yarn 21 which will then be sucked into the suction device 35. Since the spinning operation is now interrupted, the unbroken yarn 21 is located in a defined position between the spool package 30 and the suction device 35. In the meantime, the end 43 of the broken yarn 20 was wound onto the spool package 30.

Figure 3:
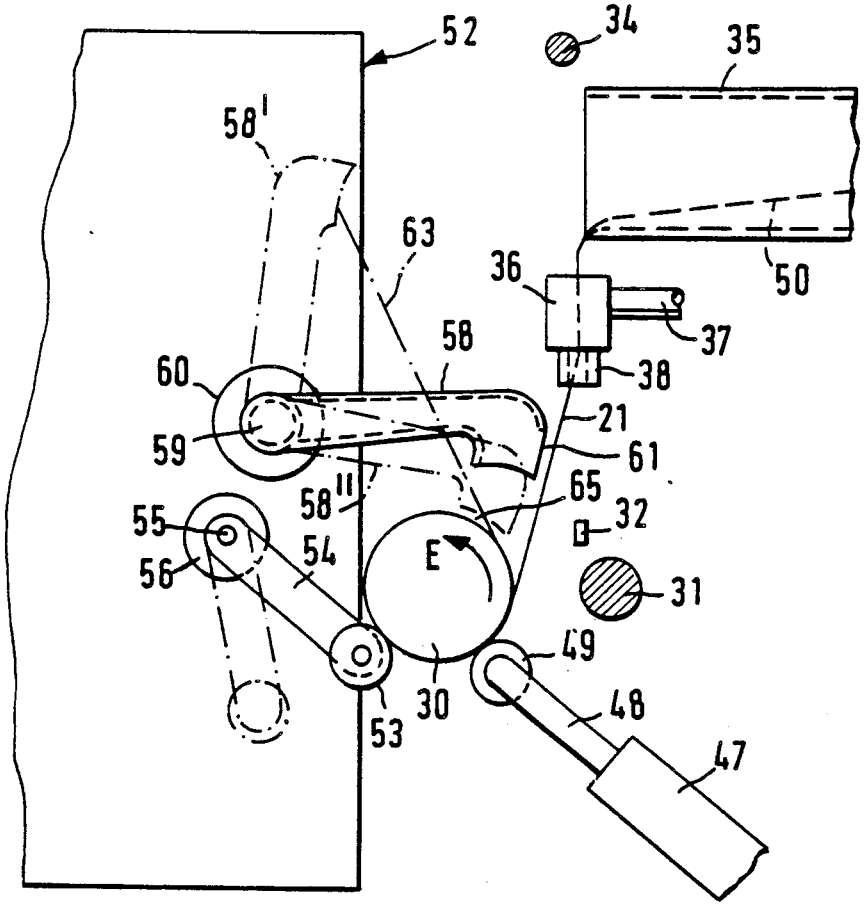
FIG. 3 is an enlarged schematic partial view of FIG. 2 showing parts of a servicing apparatus becoming operative at the respective spinning unit.

For a piecing operation, an end of the double yarn 26 must be taken off the spool package 30 and be connected again with a newly spun double yarn. This taking of the double yarn 26 off the spool package 30 and also the piecing takes place by means of a servicing apparatus 52 which can be moved along the spinning machine and, in the case of a yarn breakage, can be applied to the corresponding spinning unit. The servicing apparatus 52 contains a driving roller 53 which can be swivelled from an inoperative position shown in FIG. 3 by a dash-dotted line into the position in which it rests against the circumference of the spool package 30. The auxiliary roller 53 is arranged on an arm 54 which can be swivelled around a shaft 55 of the servicing apparatus 52 by means of an operating motor 56. The auxiliary roller 53 is also provided with a drive by means of which it may be driven in both rotating directions at a preferably adjustable speed; i.e., in wind-up direction (D) (FIG. 2) as well as in wind-off direction (E) (FIG. 3).

The servicing apparatus 52 also contains devices for picking up the double yarn 26 connected with the spool package 30; i.e., first the yarn 21, which will then be picked up and be withdrawn by the winding-off of the spool package 30, in which case, it also takes along yarn 20. In the embodiment shown, these devices contain a suction gripper 58 which can be changed from a position 58′ indicated by a dash-dotted line into the position indicated by drawn lines, in which it is applied, by means of a suction opening 61, to the yarn 21 which is located in a yarn pick-up position between the twisting nozzle 36 and the spool package 30. The suction gripper 58 is connected to a hollow shaft 59 connected with a suction source, around which it can be swivelled by means of an adjusting drive 60. The suction gripper 58 takes in the yarn 21 located in the yarn pick-up position and then swivels back to its position 58′, taking along the yarn 21 to position 63. In this case, the spool package 30 is driven in wind-off direction (E). The servicing apparatus 52 is equipped with additional devices, which are not shown in detail and which will then take over the double yarn withdrawn to position 63 and connect it with a newly pieced double yarn, particularly by means of splicing.

Should the first piecing attempt have been unsuccessful, which is monitored, for example, by means of devices of the servicing apparatus 52, which may be yarn detectors which can be applied to the newly spun yarns 20, 21, a second piecing attempt is made and, if necessary, also a third one. During this second piecing attempt, no yarn 20 or 21 can be present at the yarn pick-up position. In order to nevertheless be able to carry out a piecing operation, it is provided that, in this case, the suction gripper 58 is changed to position 58″, in which, with a suction opening 65, it is opposite the circumference of the spool package 30. In its position 58″, the suction gripper 58 tries to seek and pick up the end of the wound-up double yarn from the circumference of the spool package 30 which, during this time, is rotated in wind-off direction (E). In the case of an unsuccessful piecing attempt, it may be assumed that the double yarn broken during the piecing attempt is broken in such a manner that both yarns are broken at least approximately at the same point so that they can be found relatively easily. The suction gripper 58 will then be moved from position 58″ with the yarn 63 back into position 58′.

In the shown embodiment, it is shown that the yarn pick-up position, in which the unbroken yarn 21 (or also 20) is made available, is relatively close to the spool package 30. By means of another construction of a suction gripper and particularly of another moving mechanism, it is also contemplated to provide these positions relatively far away from one another. For example, the yarn pick-up position might also be located at the mouth of the suction device 35. In this case, it would not be necessary, as in the embodiment shown, to thread the restarted double yarn after the piecing, by means of a threading slot into the twisting nozzle 36 and the guiding pipe 38.

Should it happen that by chance both yarns 20, 21 break simultaneously or approximately simultaneously, both yarn detectors 18, 19, within a fixable time period, emit a corresponding signal to the control device 41. This control device can then decide that the servicing apparatus 52, with respect to the seeking and taking of the yarn end from the spool package will immediately carry out the "second" piecing attempt; i.e., already during the first piecing attempt, changes the suction gripper 58 to its position 58″, in which its suction opening 65 is opposite the circumference of the spool package 30.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A process for retrieving a yarn end being wound onto a spool package during a piecing operation at a spinning unit of the type supplying two adjacent prestrengthened yarns to form said spool package, said process comprising:

detecting breakage of one of the prestrengthened yarns, interrupting winding onto the spool package in such a manner that the unbroken prestrengthened yarn is disposed in a predetermined yarn pick-up position, applying a suction gripper to the unbroken prestrengthened yarn at said predetermined yarn pick-up position and moving the suction gripper and unbroken yarn to a position withdrawing the broken yarn and from the spool package for a first piecing attempt, and applying the suction gripper to adjacent the circumference of the spool package at a position spaced from the predetermined yarn pick-up position to locate the broken yarn end in the event of an unsuccessful first piecing attempt.

2. Apparatus for piecing yarn at a spinning unit of the type spinning two adjacent prestrengthened yarns which are wound together onto a spool package by winding means, said apparatus comprising:

yarn detecting means for detecting breakage of the prestrengthened yarns, winding interrupting means for interrupting the winding means in response to said yarn detecting means detecting breakage of at least one of the two yarns, and broken yarn end retrieval means for retrieving broken yarn ends from the spool package and placing them in a yarn splicing means, wherein said broken yarn end retrieval means includes a yarn gripper and a yarn gripper moving means for selectively positioning the yarn gripper at a first yarn gripping position for gripping the unbroken yarn at a predetermined location spaced substantially from the spool package in the event of breakage of only one of the yarns at a second yarn gripping position adjacent the circumference of the spool package in the event of breakage of both of the yarns.

3. Apparatus according to claim 2, further comprising yarn holding means for holding the unbroken yarn at said first position to accommodate gripping thereof by the gripping means in the event of breakage of only one of the yarns.

4. Apparatus according to claim 2, wherein control means are provided for controlling the yarn gripper moving means to move the yarn gripper to said first position to grip the unbroken yarn and then to a yarn splicing position withdrawing the unbroken yarn and the broken yarn end which adheres thereto from the spool package so that the broken yarn end is disposed in a yarn spicing means for a first yarn splicing attempt.

5. Apparatus according to claim 4, wherein the control means includes means for controlling the yarn gripper moving means to move the yarn gripper to said second position to grip the unbroken ends and then to a position withdrawing both yarn ends from the spool package so that they are disposed in the yarn splicing means in the event the first yarn splicing attempt fails.

6. Apparatus according to claim 5, wherein said yarn gripper is a suction gripper with a suction opening for accommodating both intact and broken yarn.

7. Apparatus according to claim 4, wherein said yarn gripper is a suction gripper with a suction opening for accommodating both intact and broken yarn.

8. Apparatus according to claim 2, wherein control means are provided for controlling the yarn gripper moving means to move the yarn gripper to said second position to grip the unbroken yarn ends at the spool package and then to a yarn splicing position in a yarn splicing means in the event of a double yarn breakage.

9. Apparatus according to claim 8, wherein said yarn gripper is a suction gripper with a suction opening for accommodating both intact and broken yarn.

10. Apparatus according to claim 2, wherein said yarn gripper is a suction gripper with a suction opening for accommodating both intact and broken yarn.

11. Apparatus according to claim 10, wherein said second yarn gripping position is a yarn end seeking position where the yarn gripper can seek the broken yarn ends on the spool package.

12. Apparatus according to claim 2, wherein said second yarn gripping position is a yarn end seeking position where the yarn gripper can seek the broken yarn ends on the spool package.

13. A method for piecing yarn at a spinning unit of the type spinning two adjacent prestrengthened yarns which are wound together onto a spool package by winding means, said method comprising;

detecting breakage of the prestrengthened yarns, interrupting the winding means in response to detecting breakage of at least one of the two yarns, and retrieving broken yarn ends from the spool package and placing them in a yarn splicing means, wherein said retrieving includes using a yarn gripper and a yarn gripper moving means for selectively positioning the yarn gripper at a first yarn gripping position for gripping the unbroken yarn at a predetermined location spaced substantially from the spool package in the event of breakage of only one of the yarns and at a second yarn gripping position adjacent the circumference of the spool package in the event of breakage of both of the yarns.

14. A method according to claim 13, further comprising holding the unbroken yarn at said first position to accommodate gripping thereof by the gripping means in the event of breakage of only one of the yarns.

15. A method according to claim 13, wherein control means are provided for controlling the yarn gripper moving means to move the yarn gripper to said first position to grip the unbroken yarn and then to a yarn splicing position withdrawing the unbroken yarn and the broken yarn end which adheres thereto from the spool package so that the broken yarn end is disposed in a yarn splicing means for a first yarn splicing attempt.

16. A method according to claim 15, wherein the control means includes means for controlling the yarn gripper moving means to move the yarn gripper to said second position to grip the unbroken yarn ends and then to a position withdrawing both yarn ends from the spool package so that they are disposed in the yarn splicing means in the event the first yarn splicing attempt fails.

17. A method according to claim 16, wherein said yarn gripper is a suction gripper with a suction opening for accommodating both intact and broken yarn.

18. A method according to claim 15, wherein said yarn gripper is a suction gripper with a suction opening for accommodating both intact and broken yarn.

19. A method according to claim 13, wherein control means are provided for controlling the yarn gripper moving means to move the yarn gripper to said second position to grip the unbroken yarn ends at the spool package and then to a yarn splicing position in a yarn splicing means in the event of a double yarn breakage.

20. A method according to claim 19, wherein said yarn gripper is a suction gripper with a suction opening for accommodating both intact and broken yarn.

21. A method according to claim 13, wherein said yarn gripper is a suction gripper with a suction opening for accommodating both intact and broken yarn.

22. A method according to claim 21, wherein said second yarn gripping position is a yarn end seeking position where the yarn gripper can seek the broken yarn ends on the spool package.

23. A method according to claim 13, wherein said second yarn gripping position is a yarn end seeking position where the yarn gripper can seek the broken yarn ends on the spool package.

* * * * *